US006192528B1

(12) United States Patent
Martinez

(10) Patent No.: US 6,192,528 B1
(45) Date of Patent: Feb. 27, 2001

(54) RECYCLOPOOL

(76) Inventor: Marie F. Martinez, 7290 Oak Meadows Cr., Orlando, FL (US) 32835

( * ) Notice: Subject to any disclaimer, the term of this patent is extended or adjusted under 35 U.S.C. 154(b) by 0 days.

(21) Appl. No.: 09/518,238

(22) Filed: Mar. 3, 2000

(51) Int. Cl.[7] ..... E04H 4/00
(52) U.S. Cl. ..... 4/507; 4/506
(58) Field of Search ..... 4/506, 507, 488, 4/490, 496, 494, 499, 650, 295, 653, 652, 658, 656, 596; 239/601, 592, 594, 597, 122, 499, 518; 138/39; 251/118

(56) References Cited

U.S. PATENT DOCUMENTS 577,362 * 2/1897 Ettlinger ..... 239/602
2,084,236 6/1937 Babb .
2,838,768 6/1958 Fischett .
4,383,564 * 5/1983 Hoie ..... 150/0.5
5,016,296 5/1991 Beaumont .
5,103,508 4/1992 Counts .

* cited by examiner

*Primary Examiner*—Henry J. Recla
*Assistant Examiner*—Huyen Le
(74) *Attorney, Agent, or Firm*—Patent & Trademark Services, Inc; Joseph H. McGlynn

(57) ABSTRACT

A drain for a swimming pool. The pool has an opening adjacent a lower surface of the pool and a plug on an inner surface of the pool to close or open the drain. A hose is connected at one end to the opening adjacent a lower surface of the pool and the other end of the hose has a discharge tray connected thereto.

6 Claims, 1 Drawing Sheet

RECYCLOPOOL

BACKGROUND OF THE INVENTION

This invention relates, in general, to drains, and, in particular, to drains for swimming pools.

DESCRIPTION OF THE PRIOR ART

In the prior art various types of pool drains have been proposed. For example, U.S. Pat. No. 2,084,236 to Babb discloses a container for water which has a drain line connected at the bottom, outside surface of the container. The drain line has a valve to open or close the drain line.

U.S. Pat. No. 2,838,768 to Fischett discloses a wading pool which has a detachable plug in the bottom for draining the pool.

U.S. Pat. No. 5,016,296 to Beaumont discloses a wading pool which has a drain in the lower portion of the side of the pool. The drain has a valve which turns on and off the water in the drain.

U.S. Pat. No. 5,103,508 to Counts discloses a water container which has a drain in the side of the container near the bottom which can be controlled remotely from the top of the container.

SUMMARY OF THE INVENTION

The present invention is directed to a drain for a swimming pool. The pool has an opening adjacent a lower surface of the pool and a plug on an inner surface of the pool to close or open the drain. A hose is connected at one end to the opening adjacent a lower surface of the pool and the other end of the hose has a discharge tray connected thereto.

It is an object of the present invention to provide a new and improved drain for a swimming pool.

It is an object of the present invention to provide a new and improved drain for a swimming pool which can be adapted to any type of pool.

It is an object of the present invention to provide a new and improved drain for a swimming pool that will distribute the drain water without damage to lawns or shrubbery.

These and other objects and advantages of the present invention will be fully apparent from the following description, when taken in connection with the annexed drawings.

DESCRIPTION OF THE PREFERRED EMBODIMENT

Figure 1:
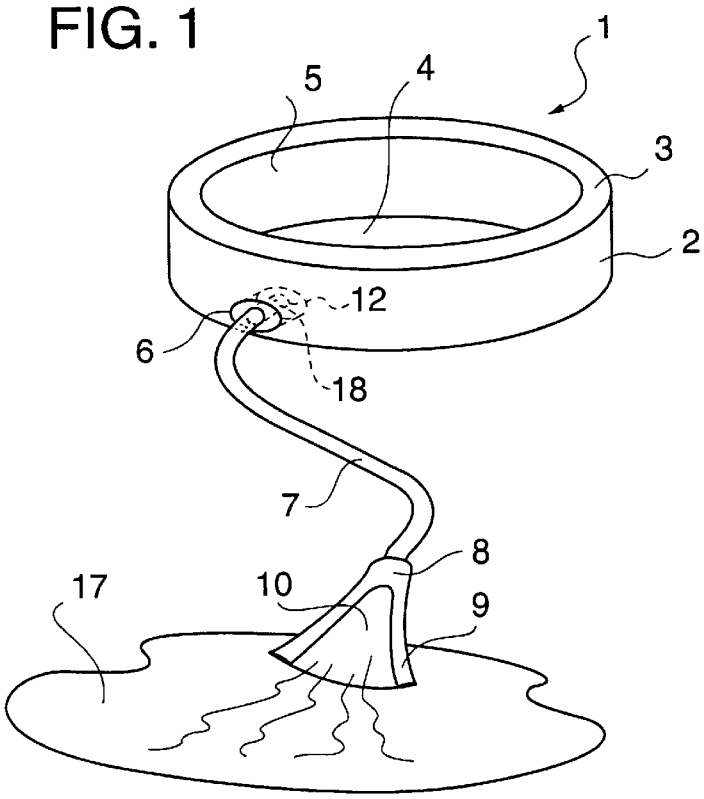
FIG. 1 is perspective view of the present invention attached to a swimming pool.

Referring now to the drawings in greater detail, FIG. 1 shows the present invention 1 secured to a swimming pool. The pool has outer side walls 1, a top 3 a bottom 4, and inner side walls 5. It should be noted that the pool, as shown in FIG. 1, is merely for illustration purposes and should not be considered the only type of pool that the present invention could be used with. For example, the pool does not need to be circular. The pool could be virtually any shape and size, and made from any conventional swimming pool material.

In the conventional swimming pool it is necessary to provide a drain such as 6, usually positioned at a lower portion of the pool. The drain is to allow an owner to drain water from the pool if the water is no longer clean. Also, if the owner decides to move the pool, it will be necessary to drain the water from the pool in order to make it light enough to move. However, even a relatively small swimming pool will hold many gallons of water. When this water is drained, it will dump all of the water onto the surface of the lawn or other surface that the pool is on. This will cause a large pool of water to be dumped onto the lawn, which could cause damage to the lawn, or at the very least, leave a pool of water on the lawn until it evaporates.

In order to avoid this problem, the present invention is designed to attach to any conventional swimming pool and to spread any drained water 17 away from the pool in wide dispersal pattern.

Figure 2:
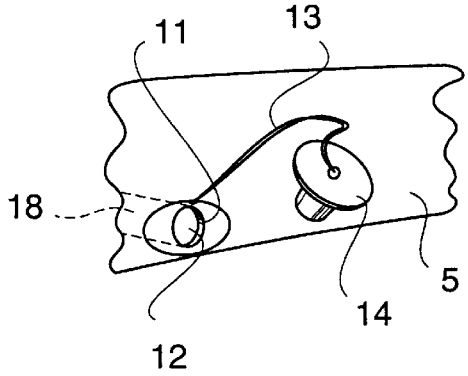
FIG. 2 is a partial view of a portion of the inside wall of the swimming pool.

In order to drain water from the pool a fitting 11 is placed in the inner wall 5 adjacent the bottom 4 of the pool as shown in FIG. 2. The fitting 11 has an aperture 12 which is connected to a passageway 18 which leads to a fitting 6 on the outer wall 2 of the pool. The fitting 11 has a plug 14 attached by a lanyard 13 which can be inserted into the aperture 12 in order to keep water in the pool.

A hose or conduit 7 is secured to the outside fitting 6. As shown the hose 7 is secured to the fitting 6 by a friction fit, however, other means of attachment can be used. For example, a conventional garden hose fitting can be used, and a garden hose can be screwed onto the garden hose fitting in order to secure a garden hose to the pool drain.

The opposite end of the hose 7 is connected to a discharge tray 8, 9, 10 which is designed to discharge the water 17 drained from the pool over a wide area. The discharge tray has a fitting 8 which will be connected to the hose 7 in any conventional manner including, but not limited to, a friction fit, or a conventional garden hose fitting.

Figure 3:
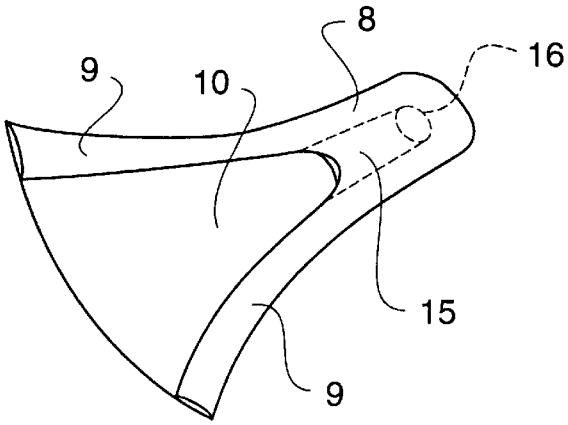
FIG. 3 is a perspective view of the discharge tray used with the present invention.

The fitting 8, as shown in FIG. 3, has an aperture 16 connected to a passageway 15 which leads from the aperture 16 to the floor 10 of the discharge tray. On opposite sides of the floor 10 are positioned walls 9 which taper away from the fitting 8, in order to make the discharge tray wider at the remote end and narrower at the end adjacent the fitting 8.

This tapering of the tray will allow the water 17 drained from the pool to be dispersed over a wide area, which will allow the water to drain from the pool with little or no damage to the lawn or surrounding areas.

Also, it should be noted that the tray 8, 9, 10 is shown in the drawings as a single piece, however, this is not critical. The tray can be made in plural pieces which would allow a narrower or wider tray 9, 10 to be attached to the fitting 8 depending on the size of the pool (and therefore, the amount of water that will be drained from the pool).

In order to use the present invention, the pool owner would first attach the hose 7 to the outside fitting 6 on the pool. Next, he/she would attach the discharge tray 8, 9, 10 to the other end of the hose 7, and position the discharge tray in a position to do a minimum of damage when the water 17 is drained from the pool. The flexibility of the hose 7 will allow the owner to place the discharge tray 8, 9, 10 in virtually any position he/she so desires. Next, the plug 14 will be removed from the inside fitting 11 on the inner wall 5 of the pool. This will allow the water, inside the pool, to drain (by gravity) through the aperture 12, through the passageway 18 into the hose 7, and finally into and out of the discharge tray 8, 9, 10.

Although the Recyclopool and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A swimming pool having inner and outer sides, a bottom and at least a partial open top, said inner sides having a drain opening therein, said outer sides having an exit opening communicating with said drain opening, a conduit connected at one end to said exit opening, said conduit having a discharge tray connected to another end, said discharge tray having one end which is wider than another end.

2. The swimming pool as claimed in claim 1, wherein said one end of said discharge tray is positioned remote from said conduit.

3. The swimming pool as claimed in claim 1, wherein said discharge tray has a floor and at least two side walls, said side walls connected to said floor and extending upwardly therefrom.

4. The swimming pool as claimed in claim 1, wherein said drain opening on said inner sides has a plug means for closing said drain opening.

5. The swimming pool as claimed in claim 4, wherein said plug means is connected to said inner sides by a lanyard.

6. A swimming pool having inner and outer sides, a bottom and at least a partial open top, said inner sides having a drain opening therein, said outer sides having an exit opening communicating with said drain opening, a conduit connected at one end to said exit opening, said conduit having a discharge tray connected to another end, said discharge tray having one end which is wider than another end, and wherein said discharge tray has a floor and at least two side walls, said side walls being connected at a bottom portion thereof to said floor, and said discharge tray has an open front and an open top.

* * * * *